US007431752B2

(12) United States Patent
Liang

(10) Patent No.: US 7,431,752 B2
(45) Date of Patent: Oct. 7, 2008

(54) AIR PURIFIER WITH OZONE REDUCTION ARRANGEMENT

(76) Inventor: ZhuHuan Liang, No. 100, Dongmei Henggag, Taiping Town, Luoding, Guangdong Province (CN)

( * ) Notice: Subject to any disclaimer, the term of this patent is extended or adjusted under 35 U.S.C. 154(b) by 0 days.

(21) Appl. No.: 11/527,179

(22) Filed: Sep. 25, 2006

(65) Prior Publication Data

US 2008/0053307 A1 Mar. 6, 2008

(30) Foreign Application Priority Data

Sep. 6, 2006 (CN) ..... 2006 1 0062501

(51) Int. Cl.
*B03C 3/68* (2006.01)

(52) U.S. Cl. ..... 95/4; 95/60; 95/67; 95/73; 96/19; 96/52; 96/74; 96/77; 96/96

(58) Field of Classification Search ..... 95/4, 95/60, 66, 67, 73; 96/19, 52, 74–79, 96
See application file for complete search history.

(56) References Cited

U.S. PATENT DOCUMENTS 2,825,102 A * 3/1958 Hicks et al. ..... 422/4
3,973,927 A * 8/1976 Furchner et al. ..... 95/3
5,656,063 A * 8/1997 Hsu ..... 95/58
5,759,487 A * 6/1998 Jung ..... 422/22
6,251,170 B1 * 6/2001 Hironaka et al. ..... 96/28
6,375,714 B1 * 4/2002 Rump et al. ..... 95/3
7,163,572 B1 * 1/2007 Liang et al. ..... 96/63
7,182,805 B2 * 2/2007 Reaves ..... 96/24
7,261,765 B2 * 8/2007 Katayama ..... 96/19
2001/0032544 A1 * 10/2001 Taylor et al. ..... 96/19
2007/0022879 A1 * 2/2007 Aiba ..... 95/58

FOREIGN PATENT DOCUMENTS

JP 6-315652 A * 11/1994 ..... 96/19

* cited by examiner

*Primary Examiner*—Richard L Chiesa
(74) *Attorney, Agent, or Firm*—Raymond Y. Chan; David and Raymond Patent Firm

(57) ABSTRACT

An air purifier includes an outer case having an air purifying cavity, an ionizer module, and an ozone reduction module. The ionizer module includes a power unit and an ionizing electrode. The ozone reduction module is electrically connected to the power unit for generating heat within the air purifying cavity, wherein when a temperature within the air purifying cavity reaches a preset temperature, a level of ozone generated by the ionizing electrode unit is substantially minimized and controlled for preventing excess generation of ozone.

20 Claims, 5 Drawing Sheets

AIR PURIFIER WITH OZONE REDUCTION ARRANGEMENT

BACKGROUND OF THE PRESENT INVENTION

1. Field of Invention

The present invention relates to an air purifier, and more particularly to an air purifier comprising an ozone reduction module for optimally controlling the amount of ozone generated by the air purifier.

2. Description of Related Arts

Air purifiers have widely been utilized all over the world for providing extra ozone emission to ambient air in indoors environment. For example, one may put an air purifier in his/her living room for enhancing the air quality therewithin.

A conventional air purifier typically comprises an outer casing and an ionizer module supported in the outer casing for ionizing ambient air and releasing a predetermined level of ozone to the ambient air in which the air purifier is operating. The ionizer module usually comprises a plurality of ionizing electrodes electrically connected to a power supply for conducting electricity so as to generate an electricity field for ionizing the ambient air which passes through the ionizing electrodes. For this kind of conventional air purifier, the ionizer module is usually detachable from a top surface of the outer casing so that the user is able to clean the ionizer module periodically for ensuring proper working thereof. Accordingly, the outer casing usually has a through top opening provided on a top surface thereof wherein the user is able to put the ionizer module into the outer casing via the top opening.

Despite its usefulness and advantages, there is a pressing problem for almost all kinds of conventional air purifiers. As a matter of fact, ozone is generated when the electrodes are charged with high voltage and the air in the vicinity of the electrodes is ionized for drawing movement of air. Ozone has a function of killing germs and bacteria which exist in air. However, for almost all conventional air purifiers, there exists no controlling mechanism for regulating the release of ozone through this ionization process. Exposure to excessive level of ozone by human beings not only affects their normal intake of oxygen, but also affects the overall metabolic rate of human bodies so that excessive exposure of ozone must be avoided by all people.

This harm caused by unregulated ozone generation is further intensified when these air purifiers are used in a confined area, such as in a bedroom with poor air ventilation. For this sort of environment, prolonged use of a conventional air purifier will certainly affect the health of the user and substantially defeat the very purpose of having such an air purifier, i.e. to maintain sufficiently clean air for maintaining good health for the users of air purifiers.

It is worth mentioning that in order to minimize ozone emission, one may lower the voltage applied to the ionizing electrodes so as to lower ozone emission from those ionizing electrodes. Although this strategy may actually reduce ozone emission from the ionizing electrodes, this reduces the overall effectiveness of the air purifier in that its ability for collecting dust and killing germs and bacteria will be significantly reduced.

SUMMARY OF THE PRESENT INVENTION

A main object of the present invention is to provide an air purifier comprising an ozone reduction module for optimally controlling the amount of ozone generated by the air purifier without affecting the overall performance of the air purifier.

Another object of the present invention is to provide an air purifier comprising an ozone reduction module which is capable of pre-heating an ionizing electrode unit within the air purifier so as to optimally control the rate at which ozone is emitted when the ionize electrode unit is operating to ionize the air within the air purifier.

Another object of the present invention is to provide an air purifier comprising an ozone reduction module which is capable of controlling ozone emission. In other words, the present invention is suitable for use in a wide variety of environments, including a confined space, a small or a medium-sized bedroom.

Another object of the present invention is to provide an air purifier which does not involve complicated mechanical and electrical components so as to minimize the manufacturing cost of the present invention.

Accordingly, in order to accomplish the above objects, the present invention provides an air purifier, comprising:

an outer case having top portion, a bottom portion, an air purifying cavity defining between the top and the bottom portion, and a peripheral opening communicating with the air purifying cavity;

an ionizer module, which comprises:

a power unit supported at the outer casing, wherein the power unit comprises an electrode terminal; and an ionizing electrode unit supported within the air purifying cavity to electrically couple with the electrode terminal for ionizing ambient air in a vicinity of the electrode element to generate an airflow and ozone within the air purifying cavity to exit at the peripheral opening of the outer casing; and an ozone reduction module electrically connecting to the power unit for generating heat within the air purifying cavity, wherein when a temperature within the air purifying cavity reaches a preset temperature, a level of ozone generated by the ionizing electrode unit is substantially minimized and controlled for preventing excess generation of ozone.

These and other objectives, features, and advantages of the present invention will become apparent from the following detailed description, the accompanying drawings, and the appended claims.

DETAILED DESCRIPTION OF THE PREFERRED EMBODIMENT

Figure 1:
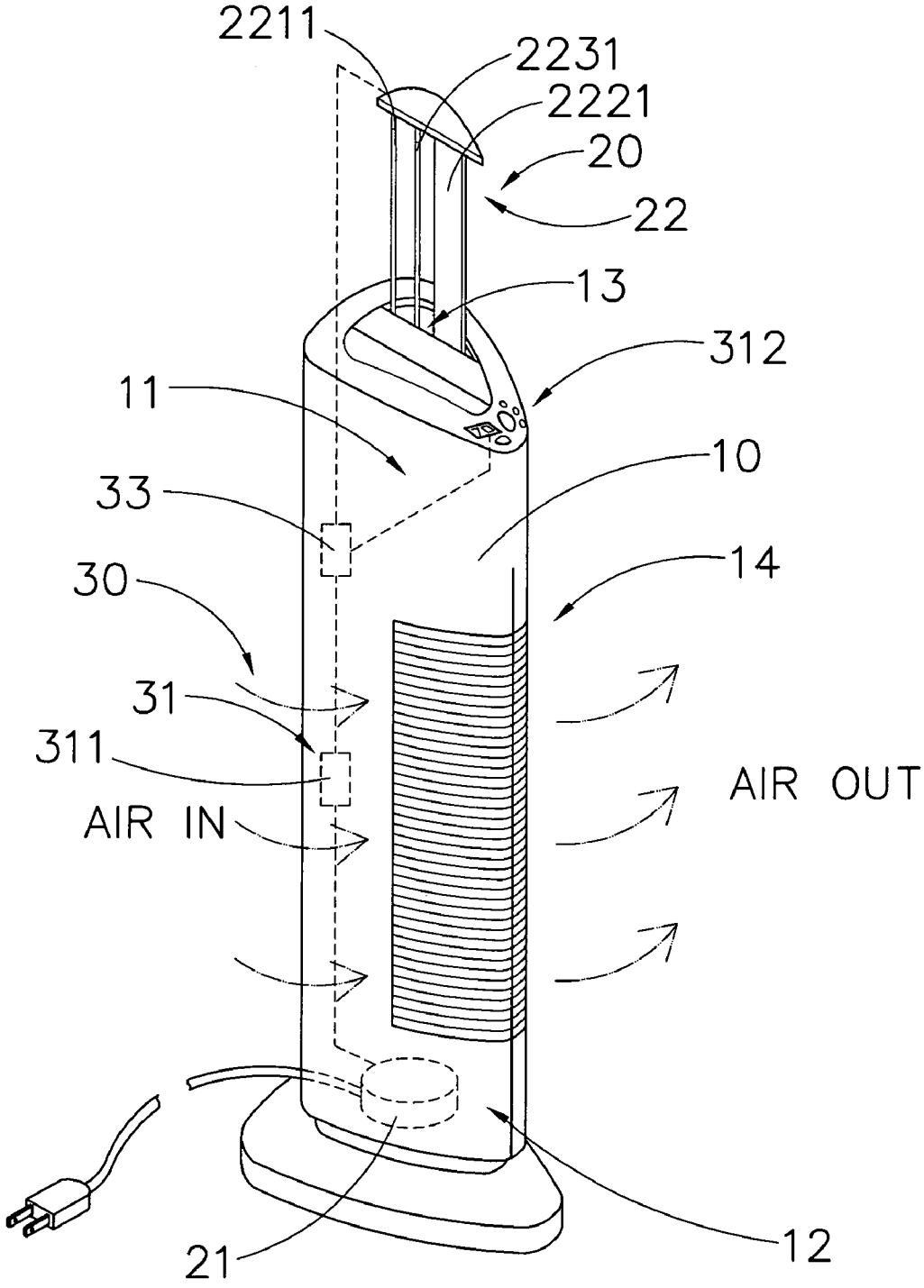
FIG. 1 is a perspective view of an air purifier according to a preferred embodiment of the present invention.
Figure 2:
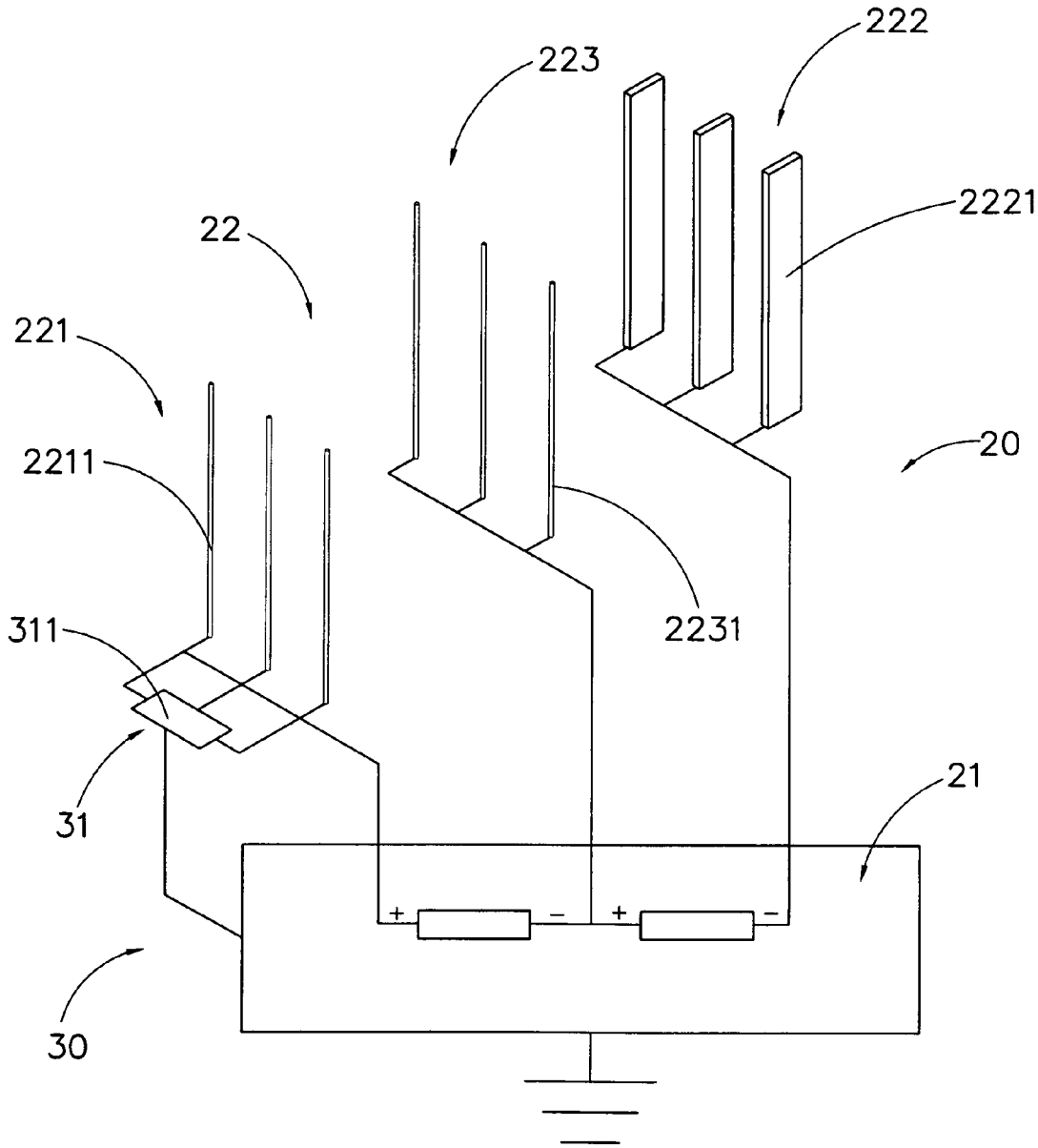
FIG. 2 is a schematic diagram of the air purifier according to the above preferred embodiment of the present invention, illustrating the electrode set within the air purifying cavity.
Figure 3:
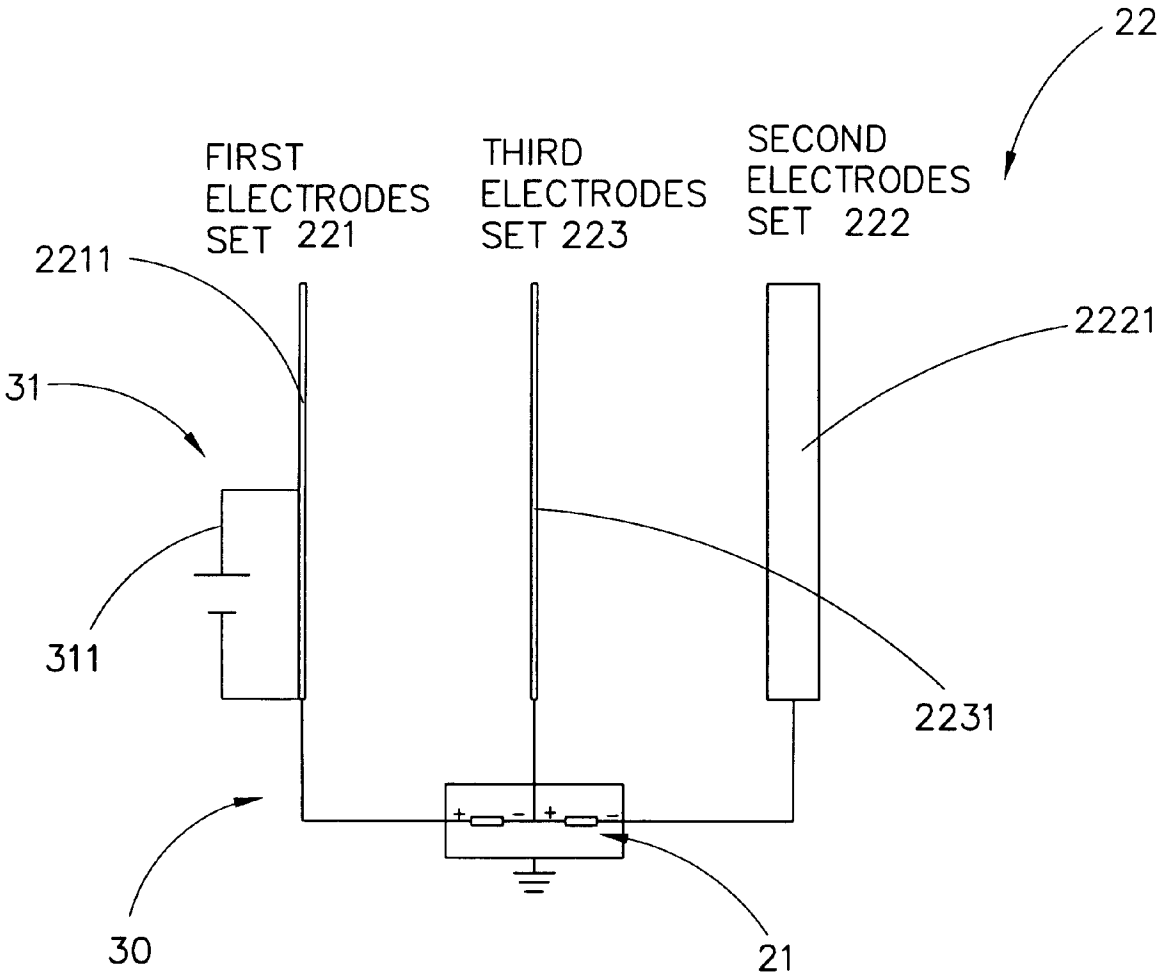
FIG. 3 is a schematic diagram of some of the electrodes sets according to the above preferred embodiment of the present invention.

Referring to FIG. 1 to FIG. 3 of the drawings, an air purifier according to a preferred embodiment of the present invention is illustrated, in which the air purifier comprises an outer case 10, an ionizer module 20, and an ozone reduction module 30.

The outer case 10 has a top portion 11, a bottom portion 12, an air purifying cavity 13 defining between the top and the bottom portion 11, 12, and a peripheral opening 14 communicating with the air purifying cavity 13.

The ionizer module 20 comprises a power unit 21 and an ionizing electrode unit 22. The power unit 21 is supported at the outer casing 10, wherein the power unit 21 comprises an electrode terminal.

The ionizing electrode unit 22 is supported within the air purifying cavity 13 to electrically couple with the electrode terminal for ionizing ambient air in a vicinity of the ionizing electrode unit 22 to generate an airflow and ozone within the air purifying cavity 13 to exit at the peripheral opening 14 of the outer casing 10.

The ozone reduction module 30 is electrically connected to the power unit 21 for generating heat within the air purifying cavity 13, wherein when a temperature within the air purifying cavity 13 reaches a preset temperature, a level of ozone generated by the ionizing electrode unit 22 is substantially minimized and controlled for preventing excess generation of ozone.

According to the preferred embodiment of the present invention, the power unit 21 of the ionizer module 20 is adapted to provide a predetermined high voltage to the ionizing electrode unit 22 for ionizing the air within the air purifying cavity 13. On the other hand, the ionizing electrode unit 22 comprises first through third electrode sets 221, 222, 223 spacedly provided within the air purifying cavity 13 for defining first through third electrode heating zones respectively in the vicinity of the respective ionizing electrode unit sets 221 (222, 223). Moreover, the first electrode set 221 comprises a plurality of first electrode elements 2211 spacedly mounted in array in the first electrode heating zone, the second electrode set 222 comprises a plurality of second electrode elements 2221 spacedly mounted in array in the second electrode heating zone, and the third electrode set 223 comprises a plurality of third electrode elements 2231 spacedly mounted in array in the third electrode heating zone.

It is worth mentioning that the first through third electrode elements 2211, 2221, 2231 may be embodied as a wide variety of electrodes which are used for air purifiers. For example, each of the first electrode elements 2211 can be embodied as an electrode wire. Similarly, each of the second electrode elements 2221 can be embodied as an electrode blade, whereas each of the third electrode elements 2231 can be embodied as an electrode wire (or a shaft) for ionizing the air within the air purifying cavity 13 so as to generate air movement and ozone.

The ozone reduction module 30 comprises a heat generator 31 installed in the air purifying cavity 13 and thermally communicated with the ionizing electrode unit 22 in such a manner that the heat generator 31 is adapted to heat up at least one of the first through third electrode sets 221, 222, 223 so as to heat up the relevant electrode heating zone. For example, the heat generator 31 can be thermally communicated with the first electrode set 221 so as to increase the temperature of the first electrode heating zone for controlling the rate at which ozone is generated when the air purifier of the present invention is operating.

More specifically, the heat generator 31 comprises a voltage source 311 electrically connected with the first electrode elements 2211 for heating the first electrode elements 2211 so as to raise the temperature of the electrode heating zone, as shown in FIG. 3 of the drawings. The first electrode elements 2211 are pre-heated by the heat generator 31 so that when the air purifier is operating, ozone emission by the first electrode elements 2211 will be reduced in accordance with the elevated temperature of the first electrode heating zone. As a matter of experimental prediction, it is envisaged that when the temperature of the first electrode heating zone reaches 100° C., ozone emission will be reduced by 50% to 80% as compared with electrodes in room temperature.

According to the preferred embodiment of the present invention, the voltage source 311 is embodied as a heat control circuit electrically coupling with the first electrode set 221 to provide additional voltage thereto so as to generate the heat along the electrode wires within the first electrode heating zone.

As a result, the heat generator 31 of the ozone reduction module 30 further comprises a control module 312 electrically connected with the heat generator 31 for controlling operational parameters of the heat generator 31. For example, the user may selectively switch at what level ozone emission is desirable so that the control module 312 can control the extent to which the first electrode heating zone is to be heated. Alternatively, the user may input the environment factor, such as the area, in which the air purifier is operating, and the control module 312 is pre-programmed to calculate an optimal ozone emission for the inputted environmental factor. For instances, the user may input the area of his bedroom and the control module 312 will then calculate the optimal level of ozone emission and regulate the temperature of the first electrode heating zone by controlling the operation of the voltage source 311.

According to the preferred embodiment of the present invention, each of the first electrode elements 2211 are made of materials which is thermally and electrically conductive so as to increase the temperature of the electrode heating zone when the ozone reduction module 30 is activated. The temperature of the first electrode zone is preferably around 60° C. to 120° C. for optimal release of ozone by the present invention. Note that the temperature at the first electrode heating zone is higher than the temperature at each of the second and third heating zones.

It is important to point out then, that the heat generator 31 of the heat generation module 30 may further comprise two voltage sources electrically connected to the second electrode elements 2221 and the third electrode elements 2231 for increasing the temperature of the second and the third electrode heating zones. These will further decrease the rate of ozone generation. Accordingly, each of the second electrode elements 2221 and the third electrode elements 2231 is made of materials which are also electrically and thermally conductive. Where heating is not required, the relevant second or third electrode element 2221, 2231 can only be made of materials which is only electrically conductive.

Moreover, the ozone reduction module 30 further comprises a temperature adjustment circuit 33 electrically coupling with the heat control circuit to selectively adjust the additional voltage to the first electrode set 221 so as to control the temperature at the first electrode heating zone, wherein the temperature at the first electrode heating zone has a range between 60° C. and 120° C.

Figure 4:
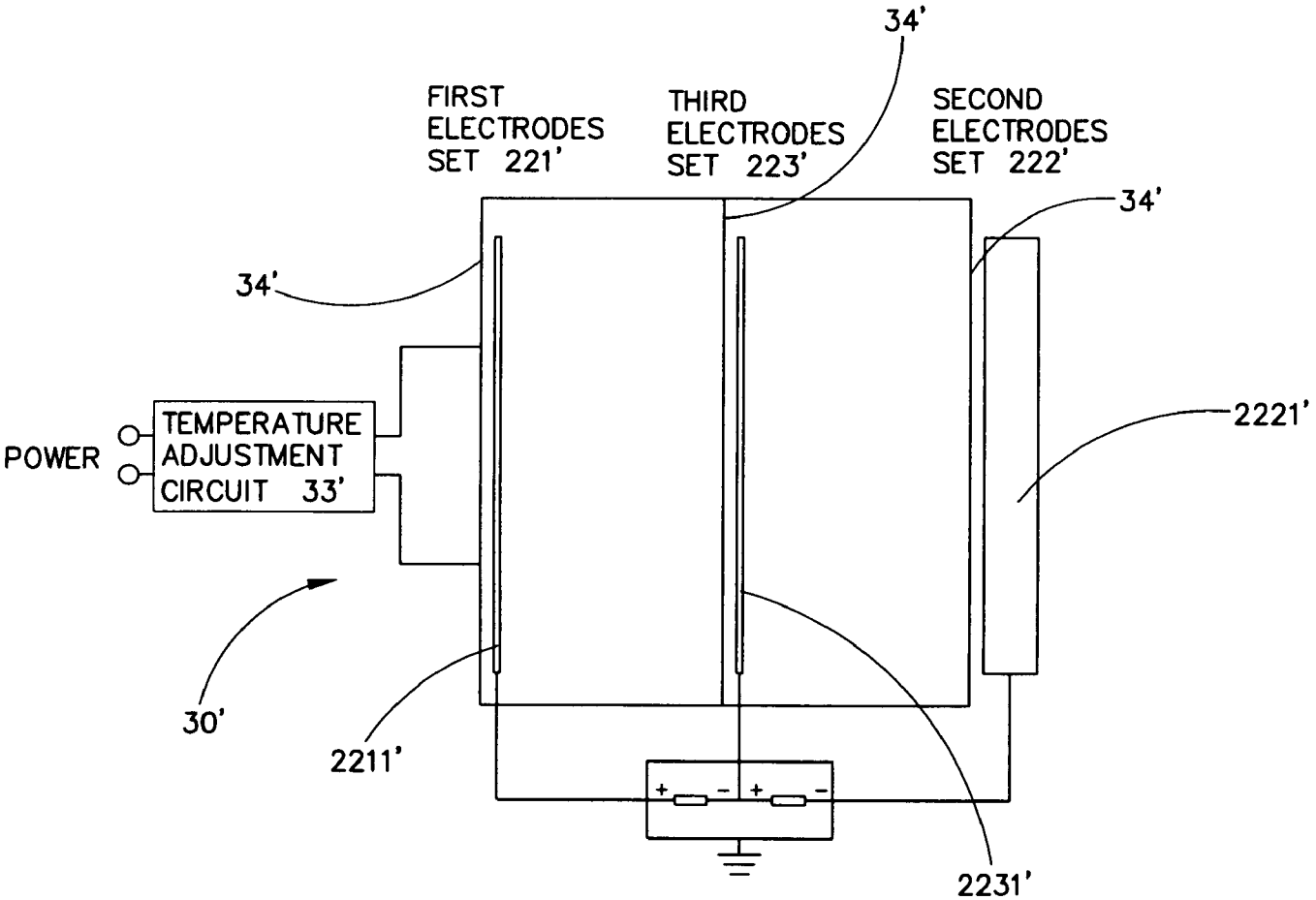
FIG. 4 is an alternative mode of the air purifier according to the above preferred embodiment of the present invention.

Referring to FIG. 4 of the drawings, an alternative mode of an air purifier according to the preferred embodiment of the present invention is illustrated. The alternative mode is similar to the preferred embodiment except the ozone reduction module 30'. According to the alternative mode, the first electrode set 221' comprises a plurality of electrode wires (the first electrode elements 2211') which are made of electrical conductive materials, spacedly mounted in array in the first electrode heating zone, wherein the ozone reduction module 30' comprises a plurality of heating wires 34' spacedly aligned with the electrode wires of the first electrode set 221' respectively to generate the heat along the heating wires 34' within the first electrode heating zone.

As a result, the ozone reduction module 30' further comprises the temperature adjustment circuit 33' electrically coupling with the heating wires 34' to selectively adjust a voltage thereof so as to control the temperature at the first electrode heating zone, wherein the temperature at the first electrode heating zone has a range between 60° C. and 120° C. It is also worth mentioning that the temperature at the first electrode heating zone is higher than temperature at each of the second and third heating zones.

It is worth mentioning that the heating wires 34' can also be provided along the second and the third electrode sets 222', 223' (i.e. the second electrode elements 2221' and the third electrode elements 2231 ') for further decreasing the production of ozone by the air purifier of the present invention.

Figure 5:
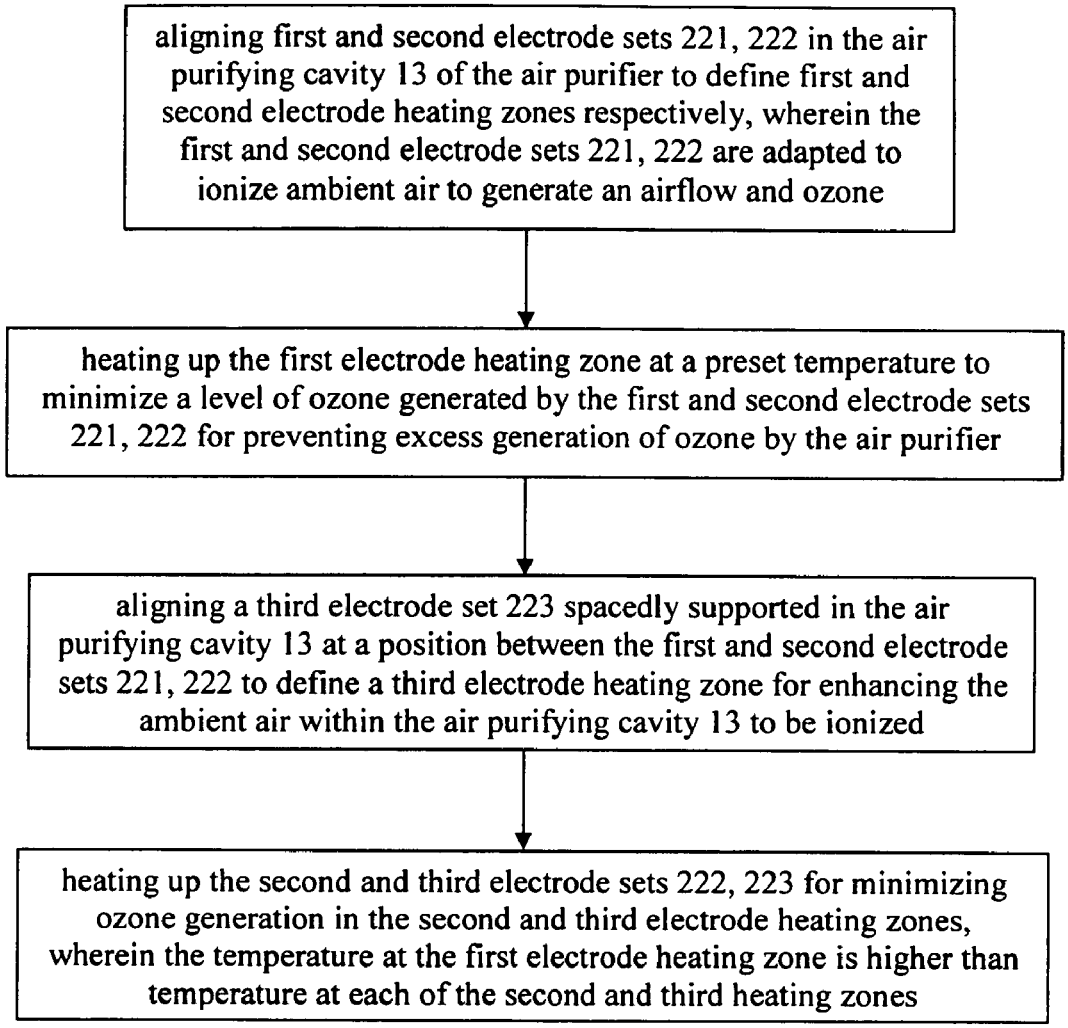
FIG. 5 is a method of purifying air with controlled ozone emission according to the above preferred embodiment of the present invention.

Referring to FIG. 5 of the drawings, a method of purifying air with controlled ozone emission according to the preferred embodiment of the present invention is illustrated, in which the method comprises the steps of:

(a) aligning first and second electrode sets 221, 222 in the air purifying cavity 13 of the air purifier to define first and second electrode heating zones respectively, wherein the first and second electrode sets 221, 222 are adapted to ionize ambient air to generate an airflow and ozone within the air purifying cavity 13; and (b) heating up the first electrode heating zone at a preset temperature to minimize a level of ozone generated by the first and second electrode sets 221, 222 for preventing excess generation of ozone by the air purifier.

According to the preferred embodiment of the present invention, step (b) comprises a step of providing additional voltage to the first electrode set 221 to generate heat thereat so as to heat up the first electrode heating zone, wherein the first electrode set 221 comprises a plurality of electrode wires, which are made of thermal and electrical conductive materials, spacedly mounted in array in the first electrode heating zone such that when the additional voltage is applied to the electrode wires, the electrode wires are heated up to generate the heat at the first electrode heating zone. Moreover, step (b) further comprises a step of controlling the temperature at the first electrode heating zone between 60° C. and 120° C.

The method further comprise the steps of:

(c) aligning a third electrode set 223 spacedly supported in the air purifying cavity 13 at a position between the first and second electrode sets 221, 222 to define a third electrode heating zone for enhancing the ambient air within the air purifying cavity 13 to be ionized; and (d) heating up the second and third electrode sets 222, 223 for minimizing ozone generation in the second and third electrode heating zones, wherein the temperature at the first electrode heating zone is higher than temperature at each of the second and third heating zones.

As an alternative as mentioned above, step (b) further comprises a step of aligning a plurality of heating wires with the first electrode set 221' to generate heat along the heating wires so as to heat up the first electrode heating zone, wherein the first electrode set 221' comprises a plurality of electrode wires, which are made of electrical conductive materials, spacedly mounted in array in the first electrode heating zone to align with the heating wires respectively such that the heating wires are heated up to generate the heat at the first electrode heating zone.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An air purifier, comprising:

an outer case having top portion, a bottom portion, an air purifying cavity defining between said top and said bottom portion, and a peripheral opening communicating with said air purifying cavity;

an ionizer module, which comprises:

a power unit supported at said outer casing, wherein the power unit comprises an electrode terminal; and an ionizing electrode unit supported within said air purifying cavity to electrically couple with said electrode terminal for ionizing ambient air in a vicinity of said ionizing electrode unit to generate an airflow and ozone within said air purifying cavity to exit at said peripheral opening of said outer casing; and an ozone reduction module electrically connecting to said power unit for generating heat within said air purifying cavity, wherein when a temperature within said air purifying cavity reaches a preset temperature, a level of ozone generated by said ionizing electrode unit is substantially minimized and controlled for preventing excess generation of ozone.

2. The air purifier, as recited in claim 1, wherein said ionizing electrode unit comprises first and second electrode sets spacedly provided within said air purifying cavity to define first and second electrode heating zones respectively in the vicinity of said respective ionizing electrode sets, wherein said ozone reduction module is electrically coupling with said first electrode set to heat up said first electrode heating zone for minimizing ozone generation in said first electrode heating zone.

3. The air purifier, as recited in claim 2, wherein said first electrode set comprises a plurality of electrode wires, which are made of thermal and electrical conductive materials, spacedly mounted in array in said first electrode heating zone, wherein said ozone reduction module comprises a heat control circuit electrically coupling with said first electrode set to provide additional voltage thereto so as to generate said heat along said electrode wires within said first electrode heating zone.

4. The air purifier, as recited in claim 3, wherein said ozone reduction module further comprises a temperature adjustment circuit electrically coupling with said heat control circuit to selectively adjust said additional voltage to said first electrode so as to control said temperature at said first electrode heating zone, wherein said temperature at said first electrode heating zone has a range between 60° C. and 120° C.

5. The air purifier, as recited in claim 2, wherein said first electrode set comprises a plurality of electrode wires which are made of electrical conductive materials, spacedly mounted in array in said first electrode heating zone, wherein said ozone reduction module comprises a plurality of heating wires spacedly aligned with said electrode wires respectively to generate said heat along said heating wires within said first electrode heating zone.

6. The air purifier, as recited in claim 5, wherein said ozone reduction module further comprises a temperature adjustment circuit electrically coupling with said heating wires to selectively adjust a voltage thereof so as to control said temperature at said first electrode heating zone, wherein said temperature at said first electrode heating zone has a range between 60° C. and 120° C.

7. The air purifier, as recited in claim 2, wherein said ionizer module further comprises a third electrode set spacedly supported in said air purifying cavity at a position between said first and second electrode sets to define a third electrode heating zone for enhancing said ambient air within said air purifying cavity to be ionized, wherein said ozone reduction module is electrically coupling with said second and third electrode set to heat up said second and third electrode heating zones for minimizing ozone generation in said second and third electrode heating zones.

8. The air purifier, as recited in claim 4, wherein said ionizer module further comprises a third electrode set spacedly supported in said air purifying cavity at a position between said first and second electrode sets to define a third electrode heating zone for enhancing said ambient air within said air purifying cavity to be ionized, wherein said ozone reduction module is electrically coupling with said second and third electrode sets to heat up said second and third electrode heating zones for minimizing ozone generation in said second and third electrode heating zones.

9. The air purifier, as recited in claim 6, wherein said ionizer module further comprises a third electrode set spacedly supported in said air purifying cavity at a position between said first and second electrode sets to define a third electrode heating zone for enhancing said ambient air within said air purifying cavity to be ionized, wherein said ozone reduction module is electrically coupling with said second and third electrode set to heat up said second and third electrode heating zones for minimizing ozone generation in said second and third electrode heating zones.

10. The air purifier, as recited in claim 7, wherein said temperature at said first electrode heating zone is higher than the temperature at each of said second and third heating zones.

11. The air purifier, as recited in claim 8, wherein said temperature at said first electrode heating zone is higher than the temperature at each of said second and third heating zones.

12. The air purifier, as recited in claim 9, wherein said temperature at said first electrode heating zone is higher than the temperature at each of said second and third heating zones.

13. A method of purifying air with controlled ozone emission for an air purifier having an air purifying cavity, comprising the steps of:

(a) aligning first and second electrode sets in said air purifying cavity of said air purifier to define first and second electrode heating zones respectively, wherein said first and second electrode sets is adapted to ionize ambient air to generate an airflow and ozone within said air purifying cavity; and (b) heating up said first electrode heating zone at a preset temperature to minimize a level of ozone generated by said first and second electrode sets for preventing excess generation of ozone by said air purifier.

14. The method, as recited in claim 13, wherein the step (b) further comprises a step of providing additional voltage to said first electrode set to generate heat thereat so as to heat up said first electrode heating zone, wherein said first electrode set comprises a plurality of electrode wires, which are made of thermal and electrical conductive materials, spacedly mounted in array in said first electrode heating zone such that when said additional voltage is applied to said electrode wires, said electrode wires are heated up to generate said heat at said first electrode heating zone.

15. The method, as recited in claim 14, wherein the step (b) further comprises a step of controlling said temperature at said first electrode heating zone between 60° C. and 120° C.

16. The method, as recited in claim 13, wherein the step (b) further comprises a step of aligning a plurality of heating wires with said first electrode set to generate heat along said heating wires so as to heat up said first electrode heating zone, wherein said first electrode set comprises a plurality of electrode wires, which are made of electrical conductive materials, spacedly mounted in array in said first electrode heating zone to align with said heating wires respectively such that said heating wires are heated up to generate said heat at said first electrode heating zone.

17. The method, as recited in claim 16, wherein the step (b) further comprises a step of controlling said temperature at said first electrode heating zone between 60° C. and 120° C.

18. The method, as recited in claim 13, further comprising the steps of:

(c) aligning a third electrode set spacedly supported in said air purifying cavity at a position between said first and second electrode sets to define a third electrode heating zone for enhancing said ambient air within said air purifying cavity to be ionized; and (d) heating up said second and third electrode sets for minimizing ozone generation in said second and third electrode heating zones, wherein said temperature at said first electrode heating zone is higher than the temperature at each of said second and third heating zones.

19. The method, as recited in claim 15, further comprising the steps of:

(c) aligning a third electrode set spacedly supported in said air purifying cavity at a position between said first and second electrode sets to define a third electrode heating zone for enhancing said ambient air within said air purifying cavity to be ionized; and (d) heating up said second and third electrode sets for minimizing ozone generation in said second and third electrode heating zones, wherein said temperature at said first electrode heating zone is higher than the temperature at each of said second and third heating zones.

20. The method, as recited in claim 17, further comprising the steps of:

(c) aligning a third electrode set spacedly supported in said air purifying cavity at a position between said first and second electrode sets to define a third electrode heating zone for enhancing said ambient air within said air purifying cavity to be ionized; and (d) heating up said second and third electrode sets for minimizing ozone generation in said second and third electrode heating zones, wherein said temperature at said first electrode heating zone is higher than the temperature at each of said second and third heating zones.

* * * * *